US012557873B2

(12) United States Patent
Becker et al.

(10) Patent No.: US 12,557,873 B2
(45) Date of Patent: Feb. 24, 2026

(54) ARTICLE OF FOOTWEAR INCLUDING A HEEL STABILIZING ELEMENT

(71) Applicant: Nike, Inc., Beaverton, OR (US)

(72) Inventors: Kevin Becker, Beaverton, OR (US); Jekti Hadiati, Beaverton, OR (US); Kyoungmin Song, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 172 days.

(21) Appl. No.: 18/310,172

(22) Filed: May 1, 2023

(65) Prior Publication Data

US 2023/0346069 A1 Nov. 2, 2023

Related U.S. Application Data

(60) Provisional application No. 63/364,008, filed on May 2, 2022.

(51) Int. Cl.

| | |
|---|---|
| ***A43B 7/1405*** | (2022.01) |
| ***A43B 3/00*** | (2022.01) |
| ***A43B 13/18*** | (2006.01) |
| ***A43B 21/32*** | (2006.01) |
| ***A43B 21/47*** | (2006.01) |

(52) U.S. Cl.

CPC ..... *A43B 7/141* (2013.01); *A43B 3/0063* (2013.01); *A43B 13/181* (2013.01); *A43B 21/32* (2013.01); *A43B 21/47* (2013.01)

(58) Field of Classification Search

CPC ..... A43B 7/141; A43B 3/063; A43B 13/181; A43B 21/32; A43B 21/47; A43B 21/36; A43B 21/39; A43B 21/45; A43B 23/088; A43B 23/0245; A43B 13/37

See application file for complete search history.

(56) References Cited

U.S. PATENT DOCUMENTS 1,972,899 A * 9/1934 Odell ..... A43B 21/32 36/140
2,738,600 A * 3/1956 Shultz ..... A43B 23/17 36/68

(Continued)

FOREIGN PATENT DOCUMENTS

EP 0096542 A1 * 2/1983
EP 0146208 A1 * 7/1984

OTHER PUBLICATIONS

International Search Report of PCT/US2023/066449, dated Aug. 14, 2023 (5 pages).

*Primary Examiner* — Heather Mangine
*Assistant Examiner* — Raquel M. Weis
(74) *Attorney, Agent, or Firm* — Bookoff McAndrews PLLC

(57) ABSTRACT

A sole structure, having a forefoot region; a mid-foot region; and a heel region; wherein the sole structure includes a midsole including a cushioning element disposed in the heel region and having a top surface, and a heel stabilizing element disposed in the heel region and around a portion of an exterior surface of the midsole, the heel stabilizing element extending from a first end disposed on a medial side of the sole structure to a second end disposed on a lateral side of the sole structure, wherein the first end of the heel stabilizing element is offset from the second end of the heel stabilizing element along a longitudinal axis of the article of footwear.

20 Claims, 13 Drawing Sheets

(56) References Cited

U.S. PATENT DOCUMENTS 3,171,218 A * 3/1965 Urbano ..... A43B 21/39 36/36 R
4,854,055 A * 8/1989 Sugiyama ..... A43B 5/001 36/68
5,692,319 A * 12/1997 Parker ..... A43C 1/00 36/114
5,946,825 A * 9/1999 Koh ..... A43B 23/028 36/55
6,192,663 B1 * 2/2001 Gatlin ..... A43C 17/04 54/83.1
6,298,582 B1 * 10/2001 Friton ..... A43B 23/027 36/102
6,401,366 B2 * 6/2002 Foxen ..... A43B 7/1495 36/102
6,594,922 B1 * 7/2003 Mansfield ..... A43B 23/081 36/173
7,082,702 B2 * 8/2006 Cretinon ..... A43B 13/026 36/76 R
8,572,867 B2 * 11/2013 Parker ..... A43B 13/14 36/153
2004/0244226 A1 * 12/2004 Farys ..... A43B 23/088 36/69
2005/0132607 A1 * 6/2005 Dojan ..... A43B 21/28 36/28
2009/0113757 A1 * 5/2009 Banik ..... A43B 13/188 36/35 R
2011/0185592 A1 * 8/2011 Nishiwaki ..... A43B 23/17 36/69
2012/0198721 A1 * 8/2012 Cavaliere ..... A43B 23/16 36/42
2013/0172799 A1 * 7/2013 Ramirez ..... A43B 13/37 602/23
2016/0029743 A1 * 2/2016 Cavaliere ..... A43B 21/24 36/105
2017/0258179 A1 * 9/2017 Conant ..... A43B 13/188
2018/0110292 A1 * 4/2018 Beers ..... A43B 3/0063
2018/0116340 A1 * 5/2018 Chang ..... A43C 7/00
2019/0231026 A1 * 8/2019 Fujita ..... A43B 7/32
2020/0205518 A1 * 7/2020 Hopkins ..... A43B 23/17
2020/0253333 A1 * 8/2020 Kilgore ..... A43B 13/181
2020/0359745 A1 * 11/2020 Tresser ..... A43B 7/24
2021/0204651 A1 * 7/2021 Thompson ..... A43B 13/16
2021/0227929 A1 * 7/2021 Ni ..... A43B 13/37
2021/0321718 A1 * 10/2021 Chang ..... A43B 23/16
2021/0361027 A1 * 11/2021 Durflinger ..... A43B 13/20
2022/0125160 A1 * 4/2022 Baza ..... A43B 13/125
2022/0192321 A1 * 6/2022 Takamasu ..... A43B 23/28
2023/0346069 A1 * 11/2023 Becker ..... A43B 13/37

* cited by examiner

ARTICLE OF FOOTWEAR INCLUDING A HEEL STABILIZING ELEMENT

CROSS-REFERENCE TO RELATED APPLICATION(S)

This application claims priority to U.S. Provisional Application No. 63/364,008, filed May 2, 2022, the entirety of which is incorporated herein by reference.

FIELD

The present disclosure relates generally to articles of footwear including sole structures and more particularly to sole structures incorporating a heel stabilizing element (e.g., a heel clip).

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outer sole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

BRIEF DESCRIPTION OF DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
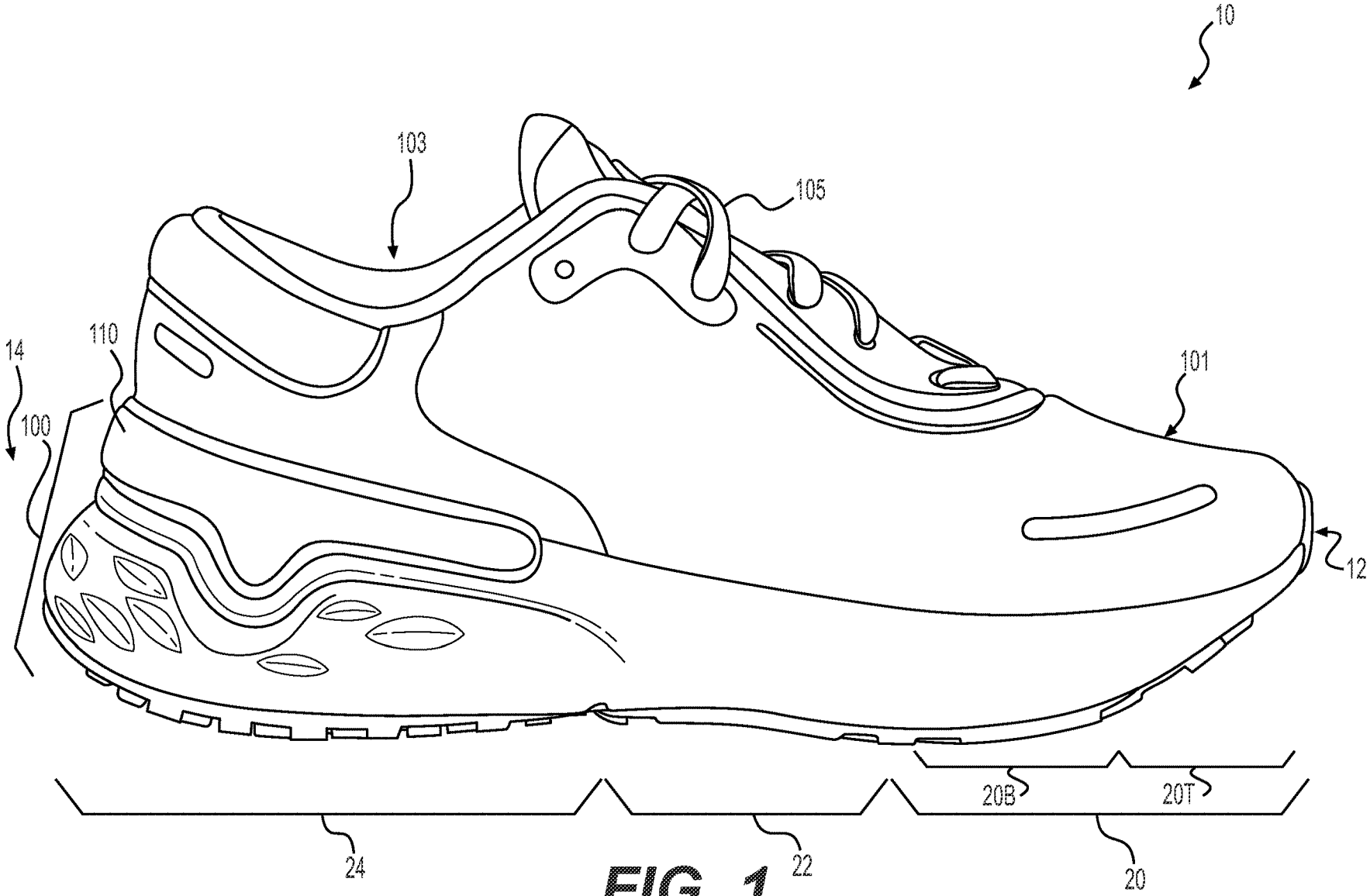
FIG. 1 is a side view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

Article of Footwear

Referring to FIG. 1, an article of footwear 10 includes a sole structure 100 and an upper 101. Generally, the sole structure 100 is configured to provide characteristics of cushioning and responsiveness to the article of footwear 10.

Figure 2A:
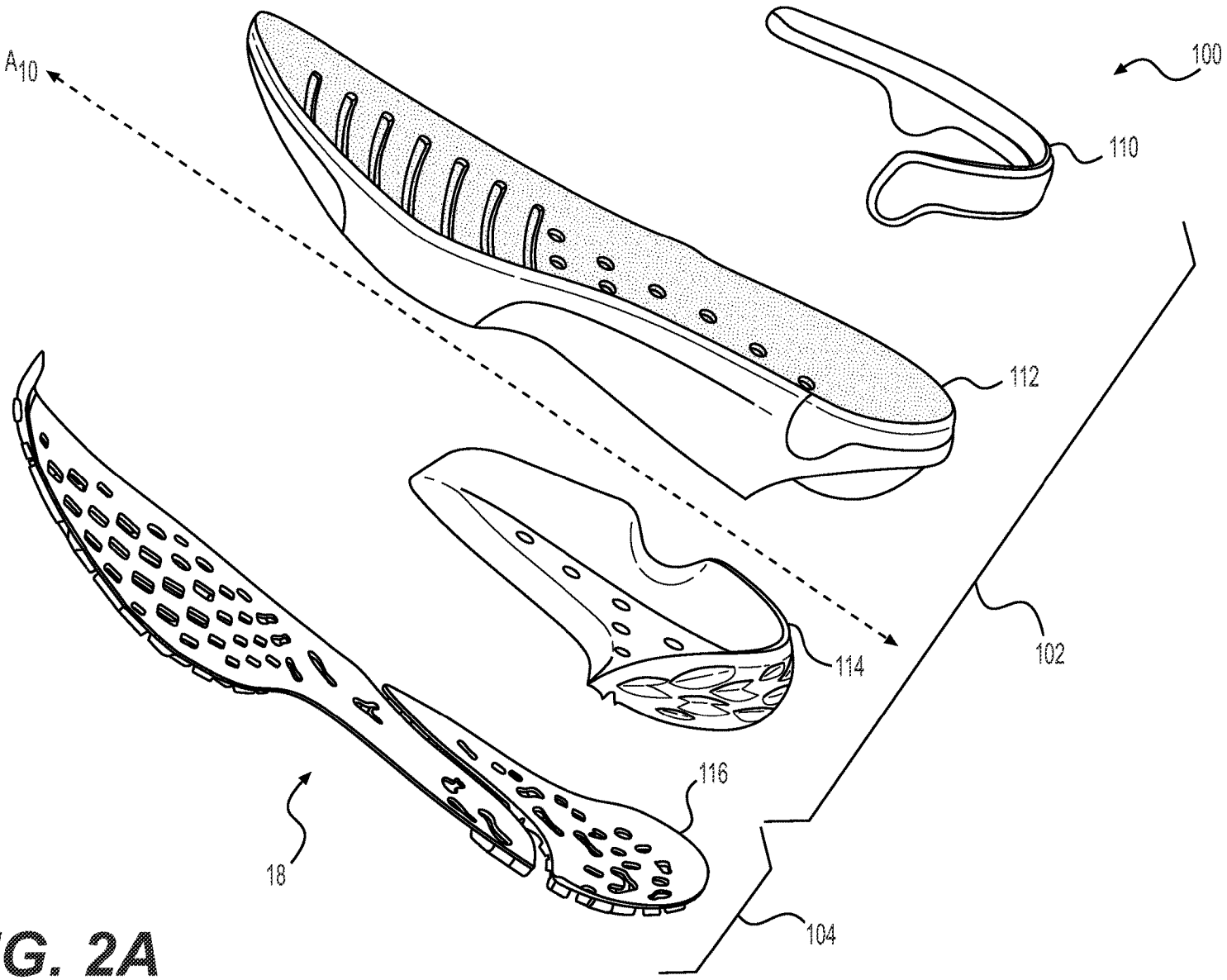
FIG. 2A is an exploded top perspective view of a sole structure of the article of footwear of FIG. 1.
Figure 2B:
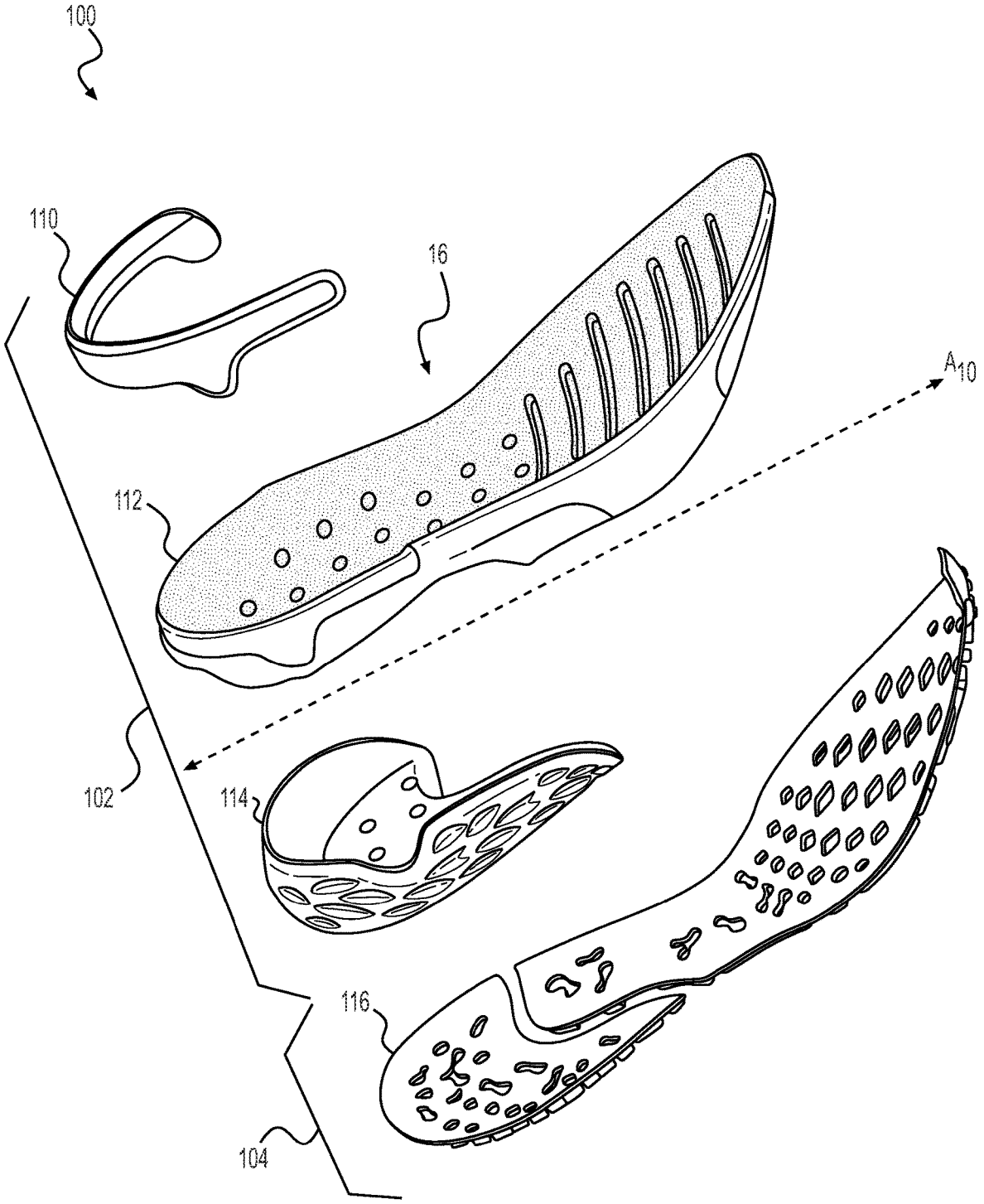
FIG. 2B is an exploded bottom perspective view of the sole structure of FIG. 2A.

The footwear 10 may further include an anterior end 12 associated with a forward-most point of the article of footwear 10, and a posterior end 14 corresponding to a rearward-most point of the footwear 10. As shown in FIGS. 2A and 2B, a longitudinal axis A10 of the footwear 10 extends along a length of the footwear 10 from the anterior end 12 to the posterior end 14, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. As illustrated in FIG. 1, the forefoot region 20 may be further subdivided into a toe portion 20T corresponding with phalanges and a ball portion 20B associated with metatarsal bones of a foot. The mid-foot region 22 may correspond with an arch area of the foot, and the heel region 24 may correspond with rear portions of the foot, including a calcaneus bone.

The upper 101 may include interior surfaces that define an interior void configured to, for example, receive and secure a foot for support on sole structure 100. The upper 101 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 101 may include a strobel having a bottom surface opposing the sole structure 100 and an opposing top surface defining a footbed of the interior void. Stitching or adhesives may secure the strobel to the upper 101. The footbed may be contoured to conform to a profile of the bottom surface (e.g., plantar) of the foot. The upper 101 may also incorporate additional layers such as an insole or sockliner that may be disposed upon the strobel and reside within the interior void of the upper 101 to receive a plantar surface of the foot to enhance the comfort of the article of footwear 10. An ankle opening 103 in the heel region 24 may provide access to the interior void. For example, the ankle opening 103 may receive a foot to secure the foot within the void and facilitate entry and removal of the foot from and to the interior void.

In some examples, one or more fasteners 105 may extend along the upper 101 to adjust a fit of the interior void around the foot and to accommodate entry and removal of the foot therefrom. The fasteners 105 may include laces, straps, cords, hook-and-loop, or any other suitable type of fastener. The upper 101 may include a tongue portion that extends between the interior void and the fasteners.

Sole Structure

Referring to FIGS. 2A and 2B, the sole structure 100 includes a midsole 102 configured to impart properties of cushioning and responsiveness, and an outsole 104 configured to impart properties of traction and abrasion resistance. The outsole 104 may define a ground engaging surface of the article of footwear 10.

The sole structure 100 may further include a heel stabilizing element (i.e. a heel clip) 110 at the posterior end 14 of the midsole 102. The midsole 102 may further comprise a cushioning element 112 and a heel cup 114. The cushioning element 112 of the midsole 102 may extend from the anterior end 12 to the posterior end 14. The outsole 104 may include an outsole element 116 attached to a bottom surface of the cushioning element 112.

Figure 3A:
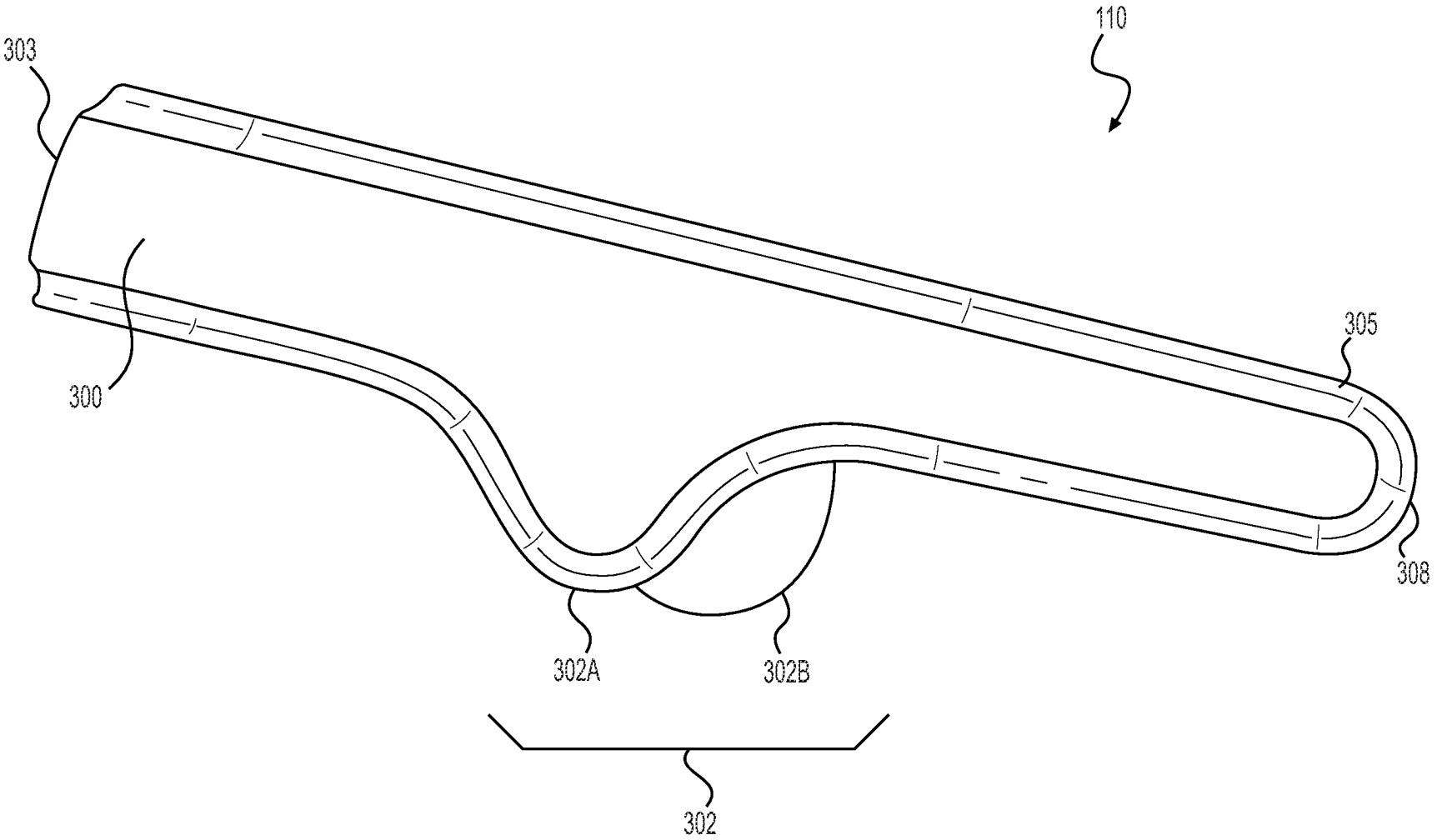
FIG. 3A is a side view of a heel stabilizing element of the article of footwear of FIG. 1.
Figure 3B:
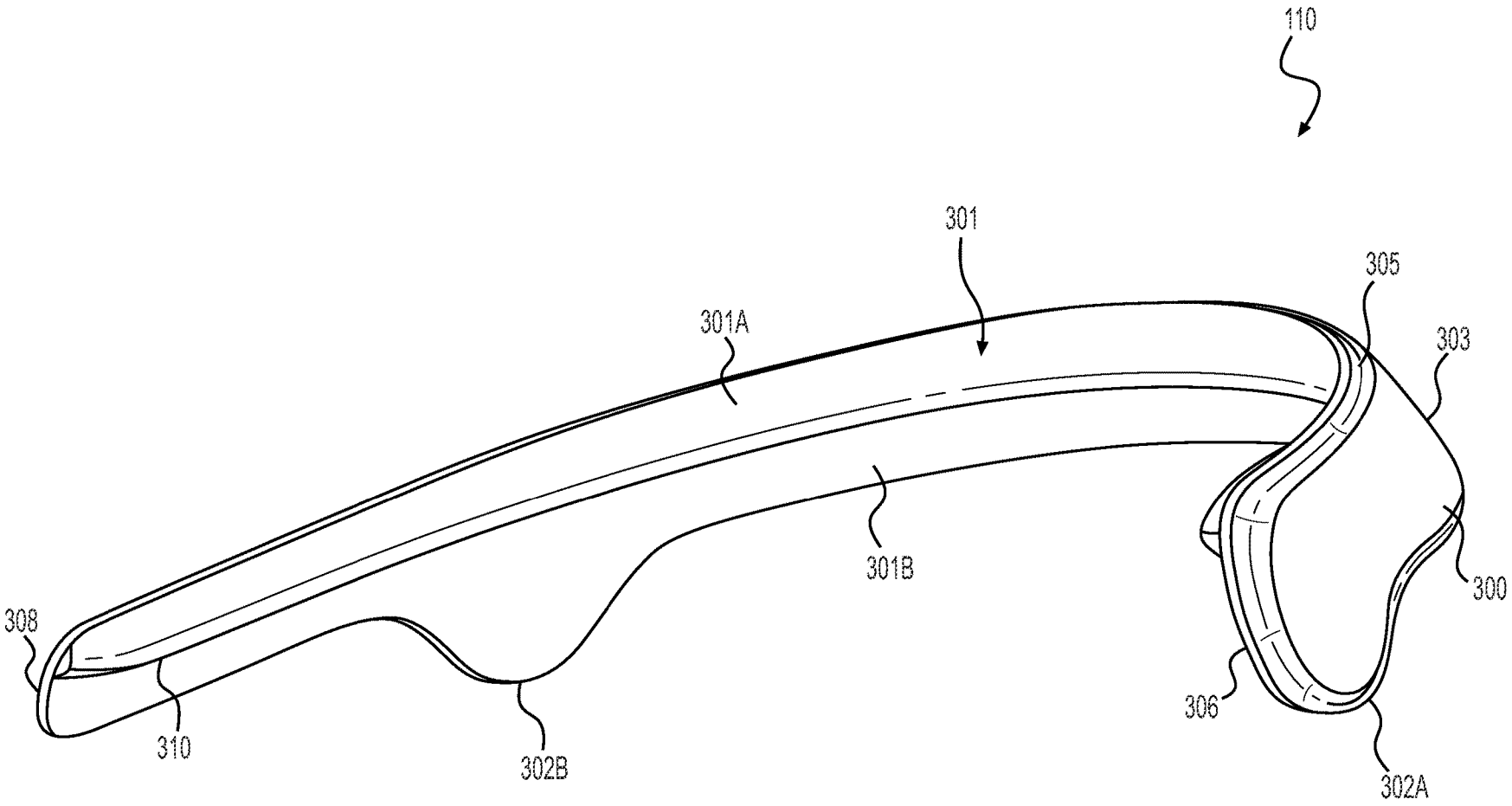
FIG. 3B is a top perspective view of the heel stabilizing element of FIG. 3A.
Figure 3C:
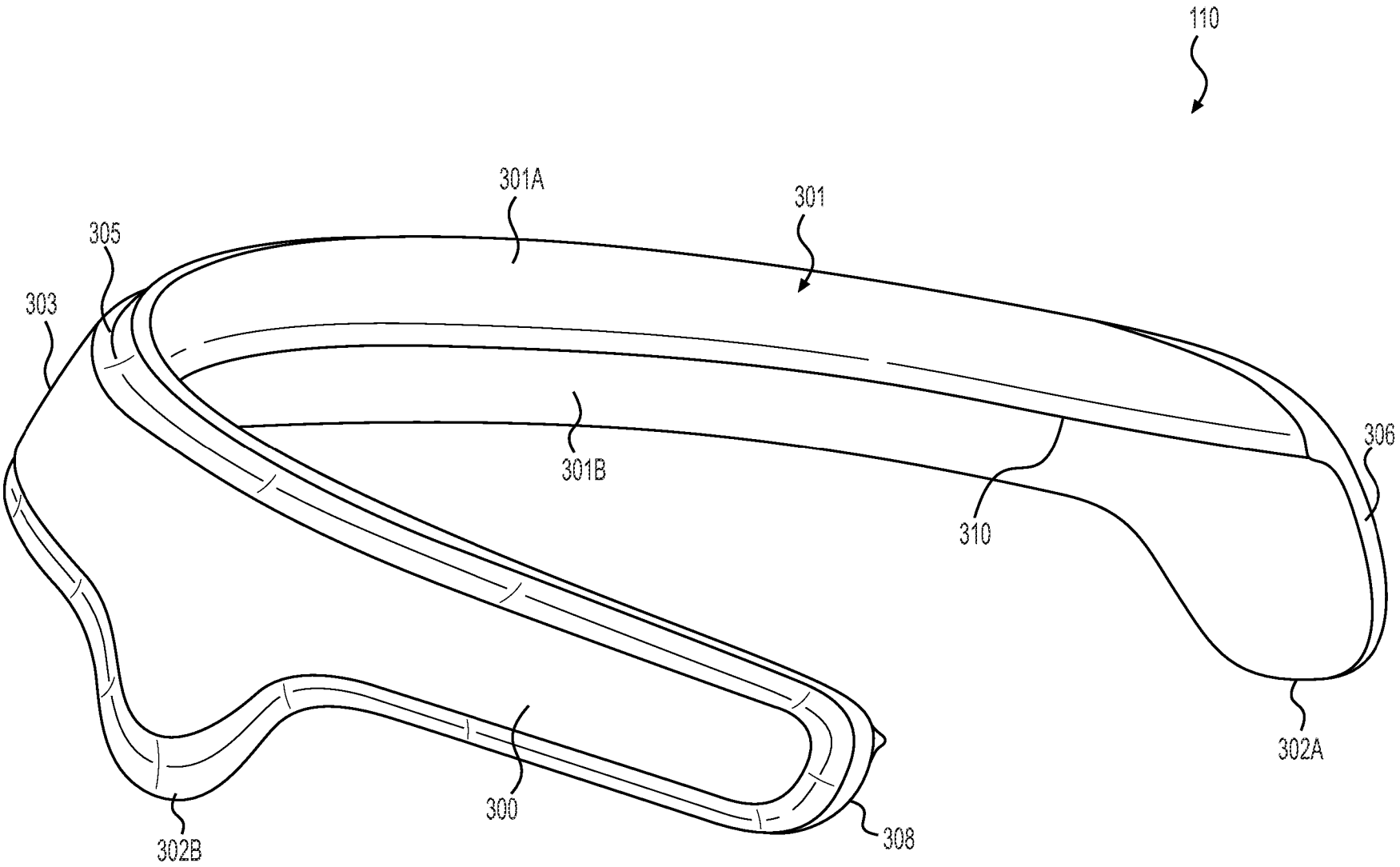
FIG. 3C is another top perspective view of the heel stabilizing element of FIG. 3A.
Figure 3D:
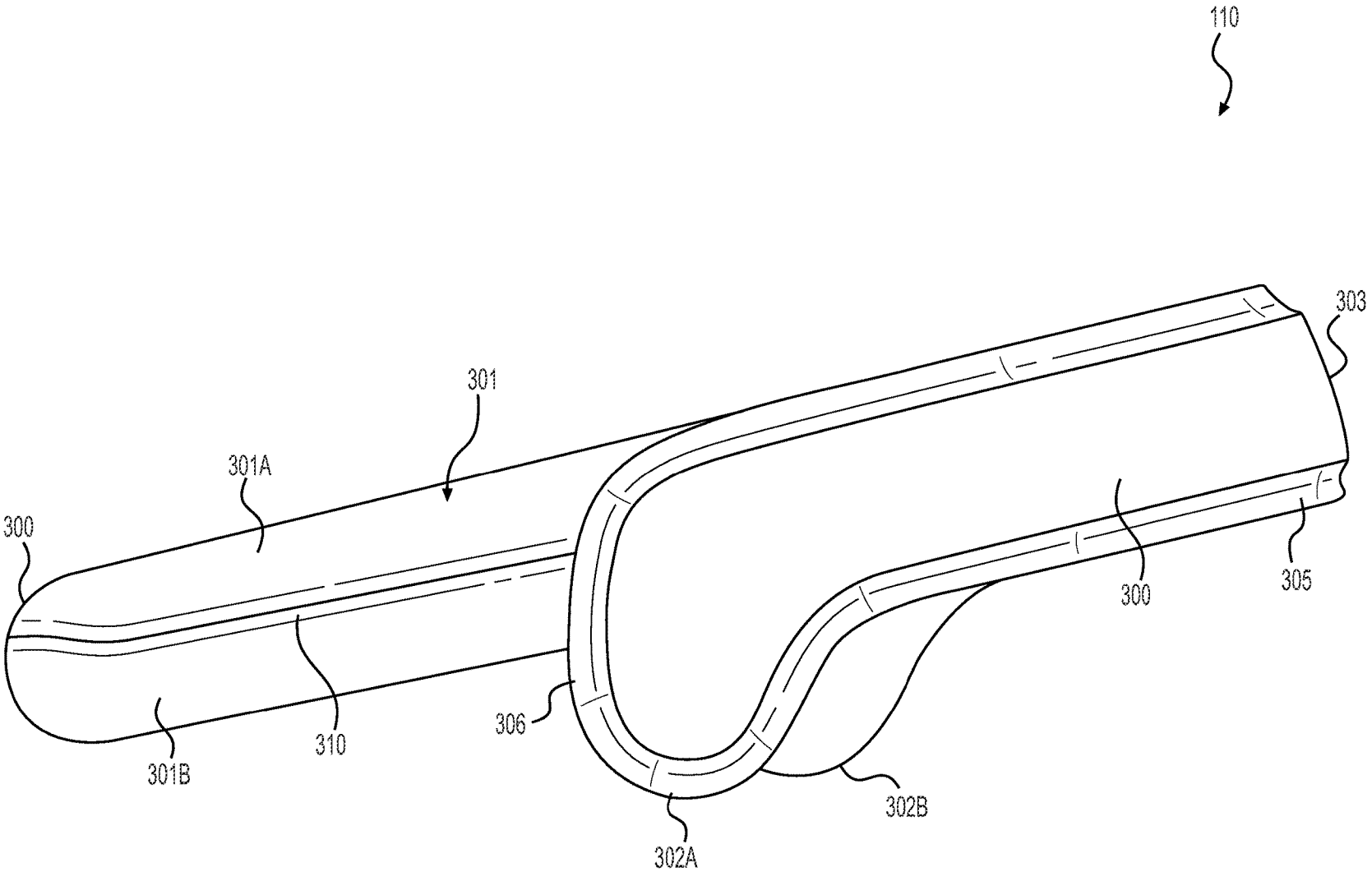
FIG. 3D is another side view of the heel stabilizing element of FIG. 3A.
Figure 3E:
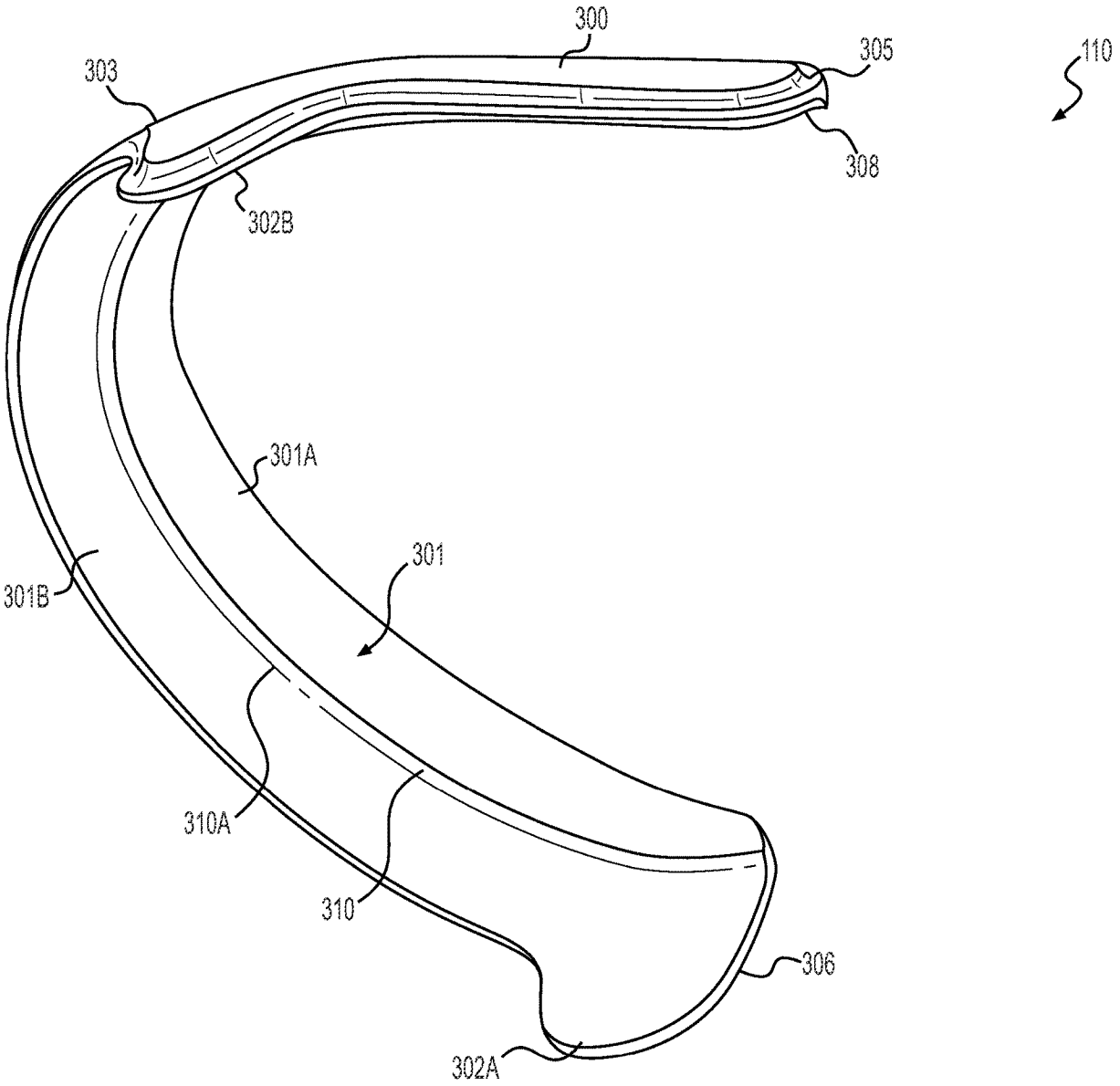
FIG. 3E is a bottom perspective view of the heel stabilizing element of FIG. 3A.
Figure 3F:
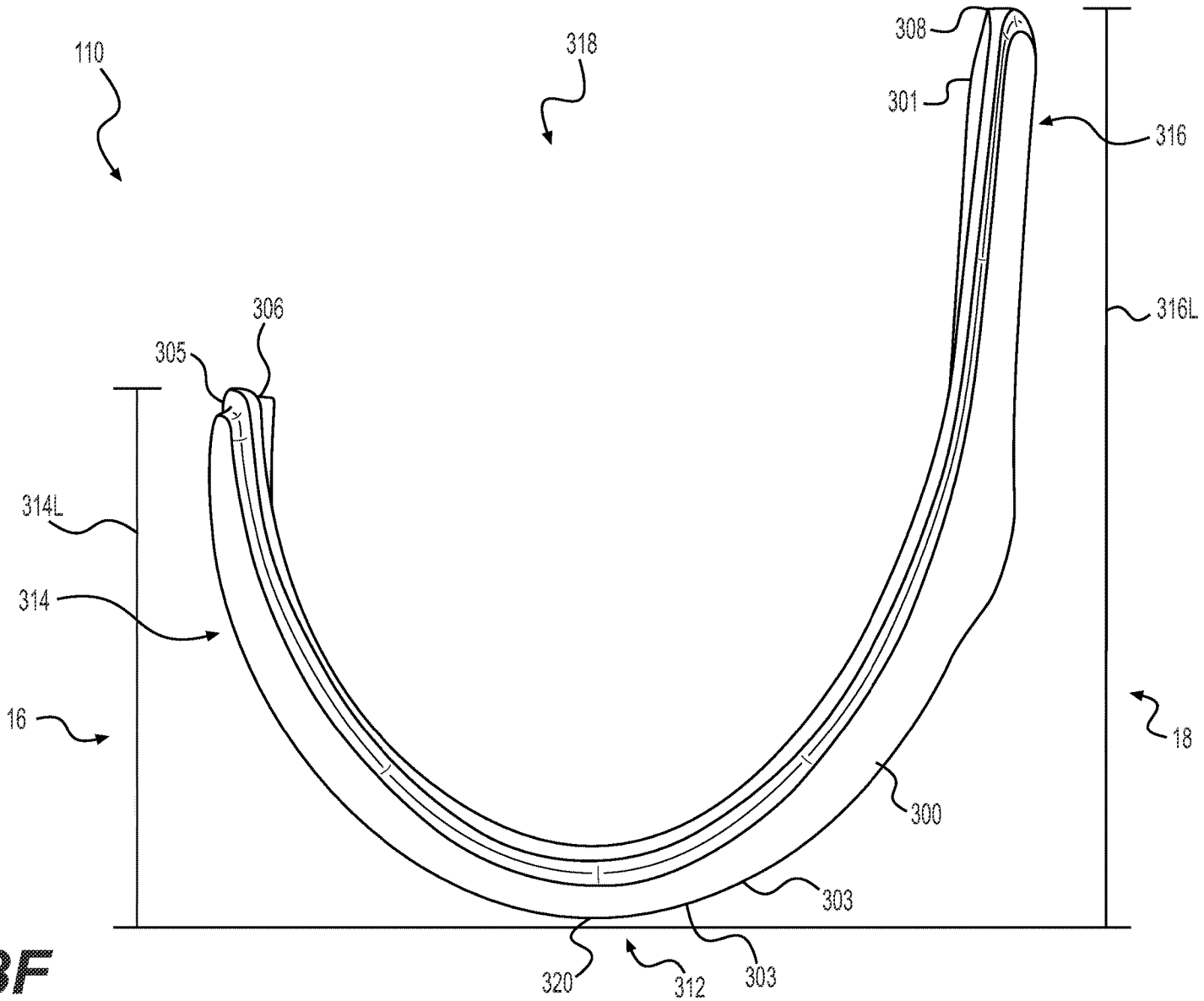
FIG. 3F is a top view of the heel stabilizing element of FIG. 3A.
Figure 4A:
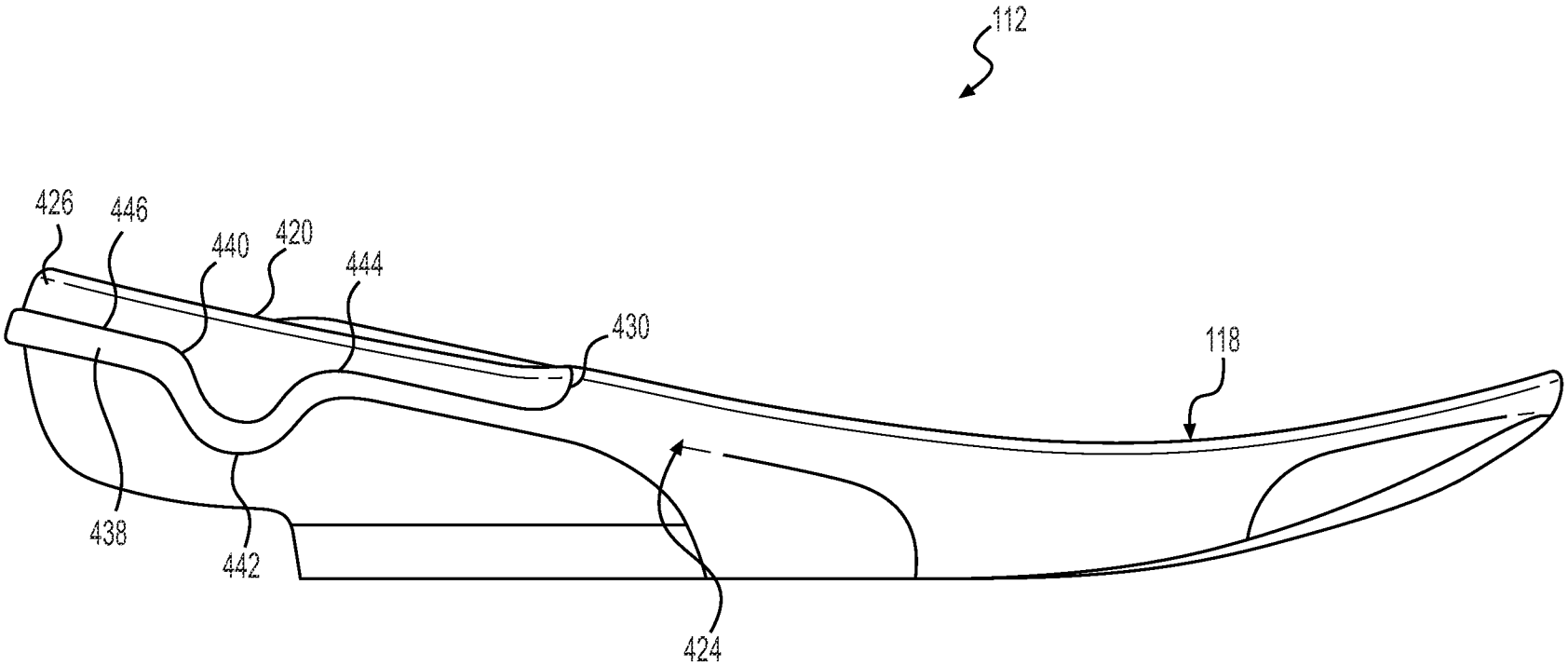
FIG. 4A is a side view of a cushioning element of the article of footwear of FIG. 1.
Figure 4B:
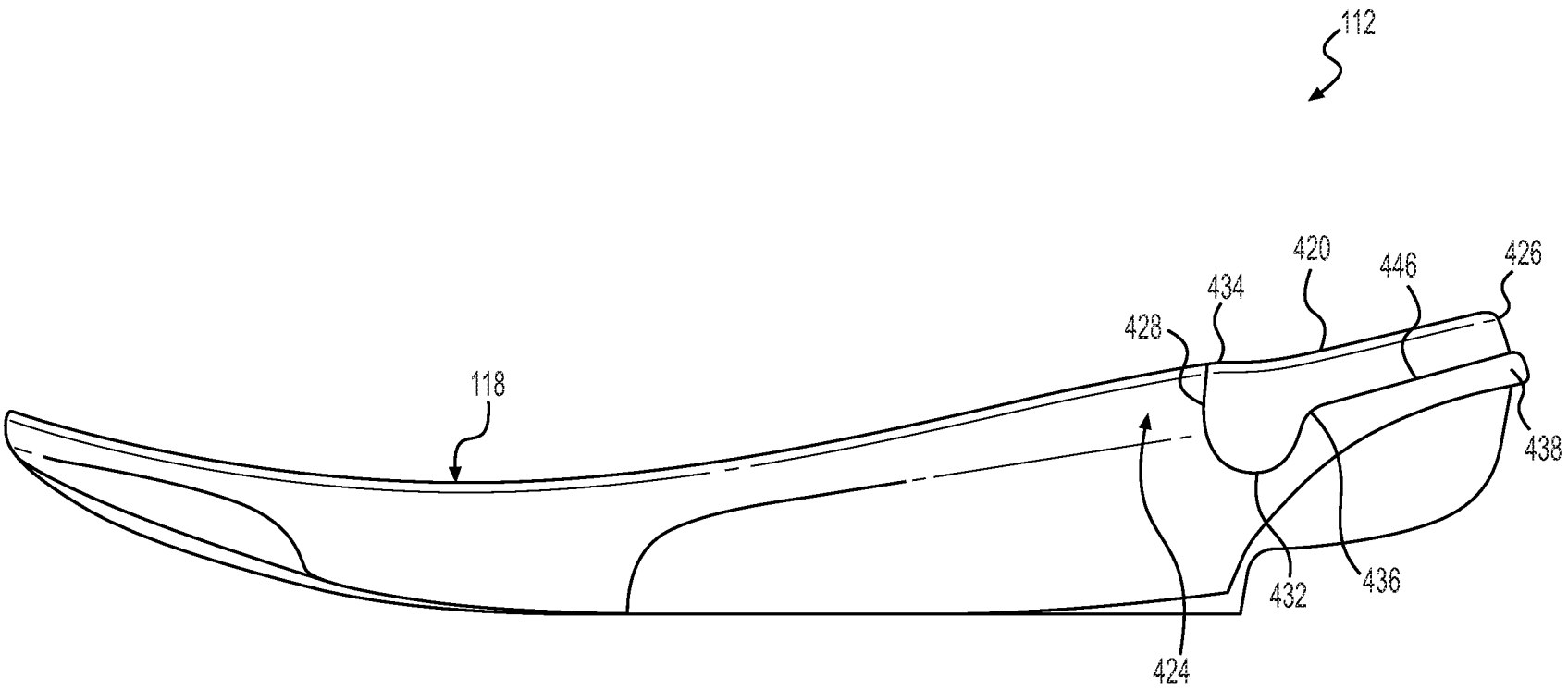
FIG. 4B is another side view of the cushioning element of FIG. 4A.
Figure 4C:
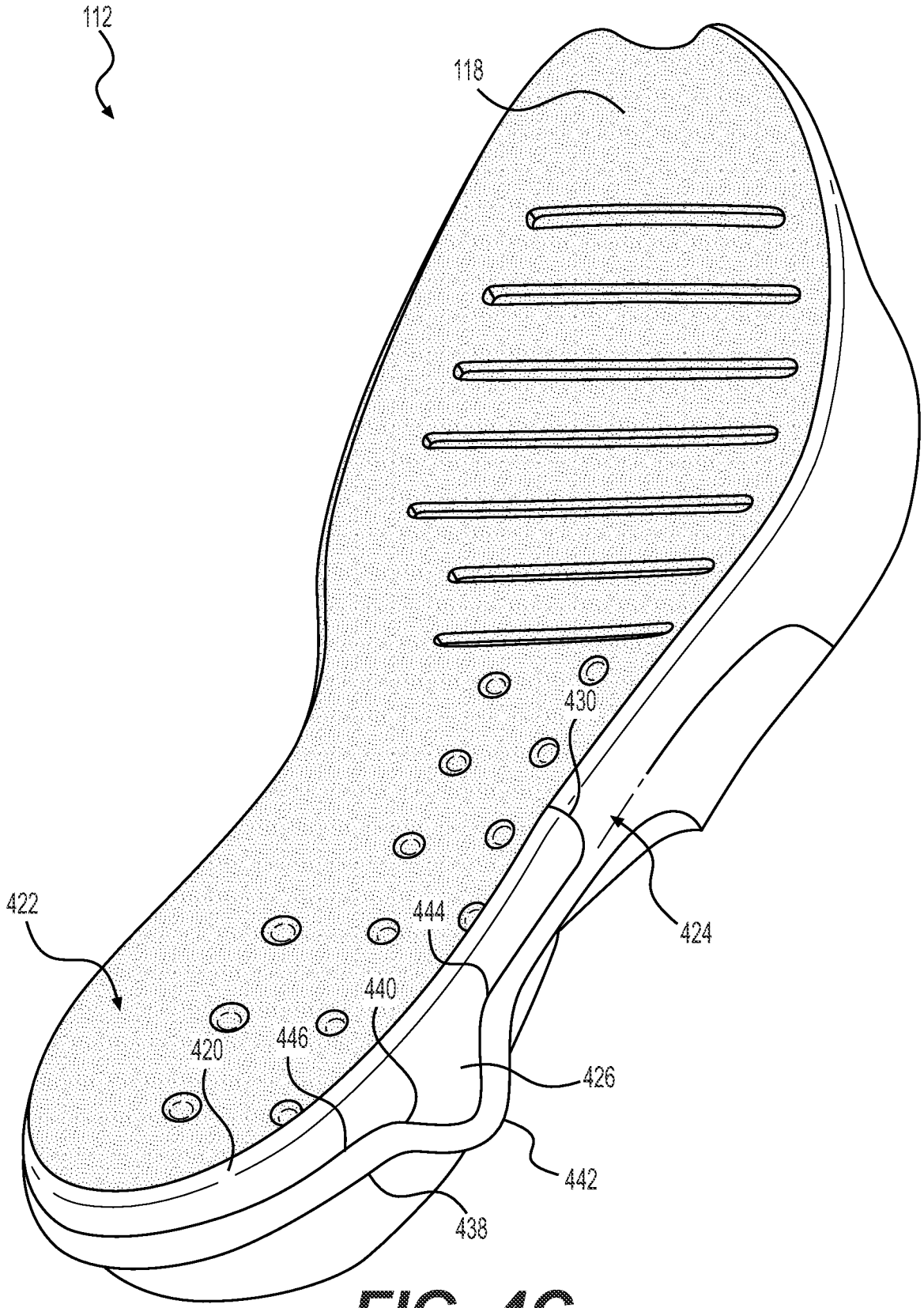
FIG. 4C is a top perspective view of the cushioning element of FIG. 4A.
Figure 4D:
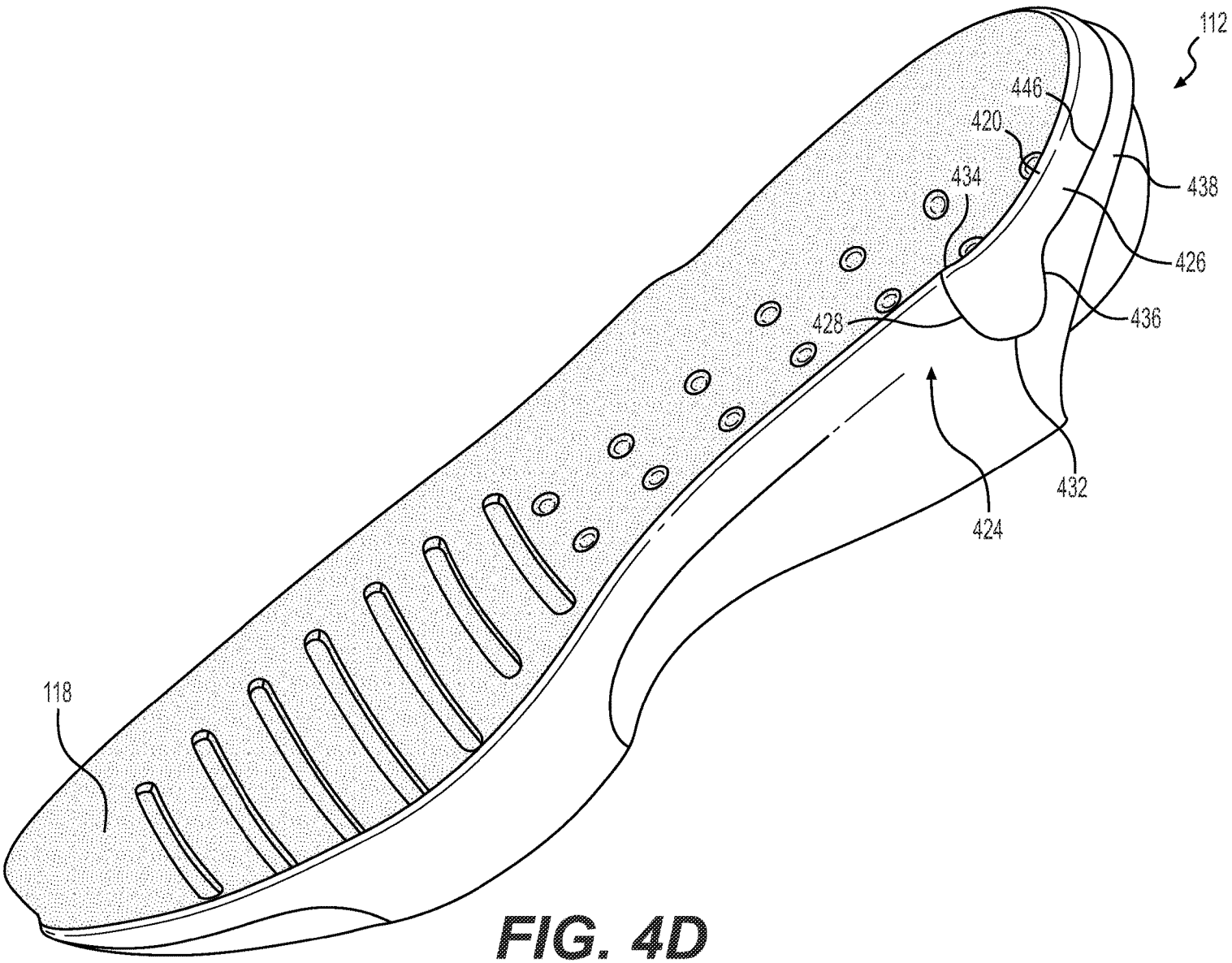
FIG. 4D is another perspective view of the cushioning element of FIG. 4A.

Referring to FIGS. 3A-3F, the heel stabilizing element 110 may fit around the rear of the article of footwear 10, so as to surround the wearer's heel. As best shown in FIG. 3F, heel stabilizing element 110 includes a body 300 that includes a base or back section 312, a medial side 314, and a lateral side 316. The medial and lateral sides 314 and 316 are coupled to the base section 312 such that the heel stabilizing element 110 forms a substantially U-shape or J-shape having an opening 318 between the medial and lateral sides 314 and 316. When the wearer inserts their foot into the shoe, the sides of the wearer's foot may push outwardly against the medial and lateral sides 314 and 316 to widen the opening 318. The heel stabilizing element 110 may engage the entire heel surface to help provide a more anatomical fit and help lock the heel into place. Moreover, the heel stabilizing element 110 may remove the need for a structural heel counter around the heel of the foot, although it is contemplated that a heel counter may be included for additional support in some embodiments.

The heel stabilizing element 110 may include an inner surface 301, and an outer surface 303, and may extend from a first end 306 to a second end 308 around the posterior end 14 of the midsole 102. Heel stabilizing element 110 also may include a top surface 300*a* and a bottom surface 300*b*. Top surface 308*a* may be disposed above the bottom surface 300*b* when outsole 116 is in contact with the ground. The first end 306 may be disposed on the medial side 314 of the heel stabilizing element 110, and the second end 308 may be disposed on the lateral side 316 of the heel stabilizing element 110. The first end 306 may be longitudinally offset from the second end 308 along a longitudinal axis of the heel stabilizing element 110. Heel stabilizing element 110 may also include a chamfer 305 disposed along an outer periphery of the outer surface 303. Chamfer may.

A majority of heel stabilizing element 110 may have a first width. However, heel stabilizing element 110 also may include one or more protruding sections 302 that extend from body 300 in a direction away from the upper 101 (e.g., toward the ground). When the article of footwear is oriented so that the outsole 116 is in contact with the ground, the protruding sections 302 may extend toward the ground from bottom surface 300*b*. At each of the one or more protruding sections 302, heel stabilizing element 110 may have a second width different from and greater than the first width that spans the majority of heel stabilizing element 110. The one or more protruding sections 302 may include a first protruding section 302A and a second protruding section 302B. First protruding section 302A may be disposed at the first end 306 on the medial side 16. Second protruding section 302B may be disposed at lateral side 18 at a location that is longitudinally spaced apart from the second end 308. Second protruding section 302B may be positioned longitudinally equidistant from the second end 308 and a posterior most portion of the lateral side 316. In an alternative embodiment, it is contemplated that the location of the second protruding section 302B may be disposed at a location that is closer to the second end 308. In another alternative embodiment, it is also contemplated that the location of the second protruding section 302B may be disposed at a location that is closer to the posterior most portion of heel stabilizing element 110.

The first protruding section 302A and the second protruding section 302B may be disposed at similar and/or overlapping longitudinal positions on opposing sides of the central longitudinal axis of the heel stabilizing element 110. In some embodiments, first protruding section 302A and second protruding section 302B may be symmetrical, although it is contemplated that they may have different shapes. In some embodiments, the longitudinal midpoints of first protruding section 302A and second protruding section 302B may be at the same longitudinal position on opposing sides of the central longitudinal axis. In an alternative embodiment, the first protruding section 302A and the second protruding section 302B may be longitudinally offset from one another. For example, all or a portion of first protruding section 302A may be disposed anterior or posterior relative to second protruding section 302B.

Referring to FIGS. 3B-3E, the inner surface 301 may include an inner rim 310. The inner rim 310 may extend along a substantial entirety or an entirety of inner surface 301 from the first end 306 to the second end 308. The inner rim 310 may include a continuous flat edge 310A that faces toward the bottom of the heel clip (i.e., toward the ground when outsole 116 is in contact with the ground). The inner rim 310 may further divide the inner surface 301 into a first (top) portion 301A and a second (bottom) portion 301B. Thus, the first portion 301A may be positioned above the second portion 301B. The second portion 301B may be recessed relative to first portion 301A. Thus, the thickness of 301A (in the direction from the inner surface 301 to the outer surface 303) may be greater than the thickness of 301B along the same direction.

In one embodiment, the heel stabilizing element 110 may be made from or otherwise include any suitable molded plastic. In the alternative, heel stabilizing element 110 may be made from or may otherwise include a metal or any other material that capable of locking the heel in place. Depending upon the material chosen, padding may be provided on the inside of the heel stabilizing element 110 for the comfort of the wearer. If desired, heel stabilizing element 110 include a plurality of parts to permit adjustability, or, as shown in the figures, heel stabilizing element 110 may be unitary in construction (i.e., may have a single-piece construction). In some examples, heel stabilizing element may be 3-D printed or formed from any suitable additive manufacturing method. Additionally, the rear (anterior) of the article of footwear 10 may include a soft material. In the alternative, a thermoplastic rubber or other material may be used to distribute the pressure to a larger region of the heel. In some examples, the heel stabilizing element 110 may include, e.g., a molded thermoplastic polyurethane member, or another suitable material.

The heel stabilizing element 110 may be attached to the cushioning element 112 by any suitable method. For example, heel stabilizing element 110 may be permanently affixed to the cushioning element 112 by sewing, or another suitable method. As some more specific examples, these components may be engaged together using adhesives or cements, mechanical connectors, or the like. In the alternative, heel stabilizing element 110 may be removably attachable to the rear of the article of footwear 10 by slipping the stabilizing element 110 in through loops or slots on the upper 101. Thus, the heel stabilizing element 110 may either be exposed on the outside of the article of footwear 10 or unexposed inside the article of footwear 10. Additionally, the heel stabilizing element 110 may be asymmetrical, as shown, with the medial side 314 slightly lower than the lateral side 316 to better accommodate to the anatomy of the foot, or symmetrical. Additionally, having the lateral side 316 longer than the medial side 314 may help reduce pronation of the foot of a user by providing relatively more support on lateral side 316 as compared to an amount of support provided on medial side 314.

Referring to FIG. 3F, the medial side 314 and the lateral side 316 may each comprise a longitudinal length. The base 312 may comprise a posterior portion of the heel stabilizing element 110. The base 312 may further include a point 320 corresponding to the posterior-most portion of the heel stabilizing element 110. The medial side 314 may comprise a medial longitudinal length 314L extending from a medial projection of the point 320 to the first end 306. The lateral side 316 may comprise a lateral longitudinal length 316L extending from a lateral projection of the point 320 to the second end 308. The lateral longitudinal length 316L may extend further in the longitudinal direction than the medial longitudinal length 314L. For example, the lateral longitudinal length 316L may extend a length that is greater than or equal to about 1.1 to about 3.0 times the length of the medial longitudinal length 314L, although other suitable values also are contemplated. In an exemplary embodiment, the medial longitudinal length 314L may be 4 cm and the lateral longitudinal length 316L may be 6 cm.

Referring to FIGS. 4A-4D, the cushioning element 112 may include a top surface 118 disposed opposite the bottom surface of the strobel. The cushioning element 112 may comprise a second material. The second material may be different from the first material of the heel stabilizing element 110. The first material of the heel stabilizing element 110 may comprise a stiffness that is greater than the stiffness of the second material of the cushioning element 112. The second material may be, for example, a foam, although other suitable materials are contemplated. It is contemplated that the second material may be any material suitable for providing desired characteristics of cushioning and support. In an alternative embodiment, the heel stabilizing element 110 and the cushioning element 112 may comprise the same material, for example to facilitate recycling of heel stabilizing element 110 and cushioning element 112 together.

The cushioning element 112 may include an outer surface 424 extending around the periphery of top surface 118, and one or more flanges (e.g., first flange 420 and second flange 438). The cushioning element 112 may include a receiving area 426 disposed on its outer surface. The receiving area 426 may extend from a first end 428 to a second end 430. The receiving area 426 may be recessed relative to a remainder of outer surface 424.

The first end 428 may have a curved shape comprising a substantially hook shaped curve. The curved shape at the first end 428 may form a first extended portion 432. The first extended portion 432 may extend from a first area 434 disposed in the first end 428 toward a second area 436. The first flange 420 may extend between the first end 428 and the second end 430, and may define an upper limit of the receiving area 426. The second flange 438 may extend between the first end 428 and the second end 430, and may define the lower limit of the receiving area 426. A portion of the flange 438 may extend from the second area 436 toward a third area 440. The third area 440 may form a beginning of a second extended portion 442. The second extended portion 442 may extend from the third area 440 toward a fourth area 444 forming a valley. The second extended portion 442 may comprise a rounded surface that is concave when viewed from directly above the sole structure 100 while the outsole 104 of the article of footwear 10 is engaging a ground surface. The second portion 442 may be substantially V-shaped or U-shaped. The second flange 438 may continue from the fourth area 444 towards the second end 430. The first end 428, the first extended portion 432, the second flange 438, the second extended portion 442, and the second end 430 may cooperate to form a continuous lip 446. The continuous lip 446 may be configured to cooperate with a portion of the heel stabilizing element 110.

Referring to FIGS. 1-2B, the receiving area 426 may be configured to directly contact portion 302B of the inner surface 301 of heel stabilizing element 110. The heel stabilizing element 110 may be attached (e.g. directly attached) to the cushioning element 112 via the receiving area 426 and flanges 420 and 438. The heel stabilizing element 110 may be attached by any suitable means as discussed above. The heel stabilizing element 110 and the receiving area 426 may have corresponding geometries to assist the heel stabilizing element 110 being received by the cushioning element 112. The continuous flat edge 310A of the inner rim 310 may cooperate with and directly contact the first flange 420. Thus, first flange 420 may structurally support flat edge 301A of heel stabilizing element 110. Bottom surface 300B of heel stabilizing element may directly contact and be structurally supported by the continuous lip 446. The first protruding section 302A may directly contact and be structurally supported by the first extended portion 432. The second protruding section 302B may directly contact and be structurally supported by the second extended portion 442. The first end 306 and the second end 308 of heel stabilizing element 110 may cooperate with the first end 428 and the second end 430, respectively, of cushioning element 112. When heel stabilizing element 110 and cushioning element are coupled to one another, the first portion 301A of inner surface 301 and top surface 118 of the cushioning element 112 are substantially flush with one another to have an uninterrupted and smooth transition.

The following clauses provide an exemplary configuration for an article of footwear and sole structure described above.

Clause 1. A sole structure, comprising a forefoot region, a mid-foot region, a heel region; the sole structure including: a midsole including a cushioning element disposed in the heel region and having a top surface; and a heel stabilizing element disposed in the heel region and around a portion of an exterior surface of the midsole, the heel stabilizing element extending from a first end disposed on a medial side of the sole structure to a second end disposed on a lateral side of the sole structure, wherein the first end of the heel stabilizing element is offset from the second end of the heel stabilizing element along a longitudinal axis of the article of footwear.

Clause 2. The sole structure of Clause 1, wherein the heel stabilizing element extends from the first end to the second end around a posterior end of the midsole.

Clause 3. The sole structure of Clause 1, wherein the heel stabilizing element includes one or more protruding sections that each has a width that is larger than a width of a remainder of the heel stabilizing element.

Clause 4. The sole structure of Clause 3, wherein a first protruding section of the one or more protruding sections is disposed at the first end on the medial side.

Clause 5. The sole structure of Clause 4, wherein a second protruding section of the one or more protruding sections is disposed on the lateral side, wherein the second protruding section is spaced apart from the second end.

Clause 6. The sole structure of Clause 5, wherein the first protruding section and the second protruding section are positioned at a same longitudinal distance from a posterior-most point of the heel stabilizing element.

Clause 7. The sole structure of Clause 5, wherein the heel stabilizing element is of unitary construction.

Clause 8. The sole structure of Clause 1, wherein the heel stabilizing element includes an inner surface having a rim extending from the first end to the second end, and the midsole includes a top surface and a first flange that surrounds an outer periphery of the top surface, wherein the first flange and the rim are complementary in shape and the first flange abuts the rim.

Clause 9. The sole structure of Clause 8, wherein the midsole further includes an outer surface disposed adjacent to the first flange; and the inner surface of the heel stabilizing element includes a first section disposed on a first side of the rim, and a second section disposed on a second side of the rim that opposes the first side, wherein the second section of the inner surface is directly contacts the outer surface of the midsole.

Clause 10. The sole structure of Clause 9, wherein the first portion of the inner surface of the heel stabilizing element is flush with the top surface of the midsole.

Clause 11. The sole structure of Clause 10, wherein the midsole further includes a second flange raised relative to the outer surface of the midsole, wherein the second flange directly contacts a bottom surface of the heel stabilizing element.

Clause 12. The sole structure of Clause 11, wherein first section of the inner surface of the heel stabilizing element is contained entirely between the first flange and the second flange of the midsole.

Clause 13. The sole structure of Clause 8, wherein the inner rim includes a continuous flat edge that engages with the first flange.

Clause 14. The sole structure of Clause 1, wherein the heel stabilizing element is a clip.

Clause 15. The sole structure of Clause 1, wherein the heel stabilizing element has a stiffness that is greater than a stiffness of the midsole.

Clause 16. The sole structure of Clause 1, wherein the cushioning element and the heel stabilizing element comprise different materials.

Clause 17. The sole structure of Clause 1, wherein the cushioning element and the heel stabilizing element comprise only the same material.

Clause 18. The sole structure of Clause 1, wherein the heel stabilizing element includes a medial side and a lateral side that each extend from a base of the heel stabilizing element, wherein a longitudinal length of the lateral side is longer than a longitudinal length of the medial side.

Clause 19. The sole structure of Clause 1, wherein the heel stabilizing element has a U-shape or a J-shape.

Clause 20. An article of footwear comprising the sole structure of Clause 1, and an upper coupled to the sole structure.

Clause 21. A heel stabilizing element comprising a body extending from a first end to a second end, wherein the first end of the heel stabilizing element is longitudinally offset from the second end of the heel stabilizing element.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

We claim:

1. A sole structure, comprising:

a forefoot region;

a mid-foot region; and a heel region;

wherein the sole structure includes:

a midsole including a cushioning element disposed in the heel region and having a top surface; and a heel stabilizing element disposed in the heel region and around a portion of an exterior surface of the midsole, the heel stabilizing element extending from a first end disposed on a medial side of the sole structure to a second end disposed on a lateral side of the sole structure, wherein the first end of the heel stabilizing element is offset from the second end of the heel stabilizing element along a longitudinal axis of the sole structure, wherein the heel stabilizing element comprises a body and one or more protruding sections, wherein the one or more protruding sections extend from the body in a direction perpendicular to the top surface of the cushioning element, and wherein the one or more protruding sections extend from an outermost out-facing wall of the heel stabilizing element.

2. The sole structure of claim 1, wherein the heel stabilizing element extends from the first end to the second end around a posterior end of the midsole.

3. The sole structure of claim 1, wherein the one or more protruding sections each have a width that is larger than a width of a remainder of the heel stabilizing element.

4. The sole structure of claim 3, wherein a first protruding section of the one or more protruding sections is disposed at the first end on the medial side.

5. The sole structure of claim 4, wherein a second protruding section of the one or more protruding sections is disposed on the lateral side, wherein the second protruding section is spaced apart from the second end.

6. The sole structure of claim 5, wherein the first protruding section and the second protruding section are positioned at a same longitudinal distance from a posterior-most point of the heel stabilizing element.

7. The sole structure of claim 1, wherein:

the heel stabilizing element includes an inner surface having a rim extending from the first end to the second end; and the midsole includes a top surface and a first flange that surrounds an outer periphery of the top surface, wherein the first flange and the rim are complementary in shape and the first flange abuts the rim, wherein the rim of the heel stabilizing element is configured to be received by the first flange.

8. The sole structure of claim 7, wherein:

the midsole further includes an outer surface disposed adjacent to the first flange; and the inner surface of the heel stabilizing element includes a first section disposed on a first side of the rim, and a second section disposed on a second side of the rim that opposes the first side, wherein the second section of the inner surface directly contacts the outer surface of the midsole.

9. The sole structure of claim 8, wherein the first section of the inner surface of the heel stabilizing element is flush with the top surface of the midsole.

10. The sole structure of claim 9, wherein the midsole further includes a second flange raised relative to the outer surface of the midsole, wherein the second flange directly contacts a bottom surface of the heel stabilizing element.

11. The sole structure of claim 10, wherein first section of the inner surface of the heel stabilizing element is contained entirely between the first flange and the second flange of the midsole.

12. The sole structure of claim 7, wherein the rim includes a continuous flat edge that engages with the first flange.

13. The sole structure of claim 1, wherein the heel stabilizing element has a stiffness that is greater than a stiffness of the midsole.

14. The sole structure of claim 1, wherein the cushioning element and the heel stabilizing element comprise different materials.

15. The sole structure of claim 1, wherein the cushioning element and the heel stabilizing element comprise only the same material.

16. The sole structure of claim 1, wherein the heel stabilizing element includes a medial side and a lateral side that each extend from a base of the heel stabilizing element, wherein a longitudinal length of the lateral side is longer than a longitudinal length of the medial side.

17. The sole structure of claim 1, wherein the heel stabilizing element has a U-shape or a J-shape.

18. An article of footwear comprising:

the sole structure of claim 1; and an upper coupled to the sole structure.

19. A heel stabilizing element comprising:

a body extending from a first end to a second end, wherein the first end of the heel stabilizing element is longitudinally offset from the second end of the heel stabilizing element, the body comprising a top surface and a bottom surface opposite the top surface; and a plurality of protrusions extending from the body, wherein the plurality of protrusions comprises at least a first protrusion and a second protrusion on opposite sides of the body from one another, wherein the first protrusion is disposed at the first end, and the second protrusion is disposed longitudinally spaced apart from the second end, wherein the first protrusion and the second protrusion extend from the bottom surface of the body.

20. The sole structure of claim 1, wherein the one or more protruding sections includes a first protruding section and a second protruding section positioned on opposite sides of the heel stabilizing element.

* * * * *